US011713863B2

(12) United States Patent
Royer

(10) Patent No.: US 11,713,863 B2
(45) Date of Patent: Aug. 1, 2023

(54) SIGNALLING BEACON WITH REFLECTORS

(71) Applicant: OBSTA, Sevres (FR)

(72) Inventor: Alban Royer, Sevres (FR)

(73) Assignee: OBSTA, Sevres (FR)

( * ) Notice: Subject to any disclaimer, the term of this patent is extended or adjusted under 35 U.S.C. 154(b) by 0 days.

(21) Appl. No.: 17/874,023

(22) Filed: Jul. 26, 2022

(65) Prior Publication Data

US 2023/0040434 A1 Feb. 9, 2023

(30) Foreign Application Priority Data

Jul. 30, 2021 (FR) ..... 2108349

(51) Int. Cl.

| | |
|---|---|
| ***F21V 5/04*** | (2006.01) |
| ***F21S 8/00*** | (2006.01) |
| ***F21V 7/00*** | (2006.01) |
| ***F21V 7/05*** | (2006.01) |
| ***F21V 13/04*** | (2006.01) |
| *F21Y 115/10* | (2016.01) |
| *F21W 111/06* | (2006.01) |

(52) U.S. Cl.

CPC ..... *F21V 5/043* (2013.01); *F21S 8/00* (2013.01); *F21V 7/0025* (2013.01); *F21V 7/05* (2013.01); *F21V 13/04* (2013.01); *F21W 2111/06* (2013.01); *F21Y 2115/10* (2016.08)

(58) Field of Classification Search

CPC ..... F21V 5/043; F21V 7/0025; F21V 7/05; F21V 13/04; F21V 5/008; F21S 8/00

See application file for complete search history.

(56) References Cited

U.S. PATENT DOCUMENTS

| | | | | |
|---|---|---|---|---|
| 5,149,191 | A * | 9/1992 | Lewin | F21V 13/04 362/290 |
| 5,155,666 | A | 10/1992 | Radford | |
| 7,934,851 | B1 * | 5/2011 | Boissevain | F21V 29/74 362/249.02 |
| 10,788,170 | B1 * | 9/2020 | Bryan | F21K 9/27 |
| 2006/0209541 | A1 | 9/2006 | Peck | |

(Continued)

FOREIGN PATENT DOCUMENTS

| | | | |
|---|---|---|---|
| FR | 3029600 | A1 | 6/2016 |
| KR | 20170027034 | A | 3/2017 |
| WO | 2016/162849 | A1 | 10/2016 |

OTHER PUBLICATIONS

French Search Report for corresponding French application No. FR2108349, dated Apr. 26, 2022.

*Primary Examiner* — Christopher E Dunay

(74) *Attorney, Agent, or Firm* — Notaro, Michalos & Zaccaria P.C.

(57) ABSTRACT

A light projector for signalling high obstacles, having an elongate cylindrical lens, a linear light source in which the light projector has at least two reflectors and at least one of the reflectors is an upper reflector positioned above the horizontal plane of symmetry of the cylindrical lens and below an upper surface of the cylindrical lens, and at least one of the reflectors is a lower reflector positioned below the horizontal plane of symmetry of the cylindrical lens and above a lower surface of the cylindrical lens, the reflectors being configured to interrupt light rays from the light source that are oriented outside the elevation angular sector of the main flat light beam is disclosed.

9 Claims, 6 Drawing Sheets

(56) References Cited

U.S. PATENT DOCUMENTS

| | | | | |
|---|---|---|---|---|
| 2011/0156584 | A1* | 6/2011 | Kim | F21K 9/232 315/32 |
| 2017/0347437 | A1* | 11/2017 | Hager | F21V 7/0091 |
| 2018/0203242 | A1* | 7/2018 | Takeuchi | G02F 1/133606 |
| 2019/0011110 | A1* | 1/2019 | Kim | F21V 7/0091 |
| 2019/0063694 | A1* | 2/2019 | Kang | G02B 19/0066 |
| 2022/0170607 | A1* | 6/2022 | Mukojima | F21S 41/285 |

* cited by examiner

SIGNALLING BEACON WITH REFLECTORS

TECHNICAL FIELD

The invention relates to the field of signalling devices, notably for overhead signalling of high-voltage power lines, airport buildings, factory chimneys, cranes, wind turbines and pylons.

TECHNOLOGICAL BACKGROUND

Signalling devices intended for aircraft are used on high obstacles and/or cables. Such signalling devices may notably comprise cylindrical lenses in order to emit focused light in a predefined direction, as illustrated by document FR3029600 in particular.

Document FR3029600 notably describes a projector for a signalling beacon having a cylindrical lens provided with a reflector. The cylindrical lens combined with a light source allows the generation of a flat light beam that concentrates the flux of light in a given elevation angular sector.

However, a flux of light is emitted by the projector outside this flat light beam which creates light pollution for people in the vicinity.

The reflector of this document notably allows the light intensity of this light pollution to be reduced by reducing the light intensity at the elevation angle −10°.

SUMMARY

One idea on which the invention is based is to decrease the light intensity outside the elevation angular sector, which makes it possible in particular to limit light pollution for people in the vicinity.

In accordance with one embodiment, the invention provides a light projector intended to produce a directional flat light beam for signalling high obstacles, the projector comprising:

an elongate cylindrical lens the cylindrical shape of which is defined by a horizontal generatrix direction and by a directrix curve, the cylindrical lens having a length along the horizontal generatrix direction, the cylindrical lens having a horizontal plane of symmetry, a linear light source parallel to the generatrix direction, extending over all or part of the length of the cylindrical lens and arranged to emit a flux of light in the direction of the cylindrical lens, the cylindrical lens being configured to generate a main flat light beam by concentrating the flux of light in an predefined elevation angular sector around the horizontal generatrix direction in the direction of the space situated on the side opposite the cylindrical lens with respect to the light source, and being configured to project the flux of light in a predefined azimuth angular sector around the vertical direction, min which the light projector comprises at least two reflectors positioned in the space situated on the side opposite the light source with respect to the cylindrical lens, and in which at least one of the reflectors is an upper reflector positioned above the horizontal plane of symmetry of the cylindrical lens and below an upper surface of the cylindrical lens, and at least one of the reflectors is a lower reflector positioned below the horizontal plane of symmetry of the cylindrical lens and above a lower surface of the cylindrical lens, the reflectors being configured to interrupt light rays from the light source which are oriented outside the elevation angular sector of the main flat light beam.

By virtue of these features, the light intensity emitted by the projector outside the main flat beam may be reduced by virtue of the reflectors which will allow those light rays which are oriented outside the elevation angular sector to be deflected.

According to embodiments, such a projector may have one or more of the following features.

According to one embodiment, the upper reflector and the lower reflector are arranged symmetrically to one another with respect to the horizontal plane of symmetry.

According to one embodiment, the linear source is within the horizontal plane of symmetry.

According to one embodiment, the lens has an entry surface for the light rays and an exit surface opposite the entry surface, the reflectors being situated against the exit surface of the lens.

According to one embodiment, the elevation angular sector is defined as the angular sector in which the light intensity is higher than 50% of the light intensity at the centre of the flat light beam, and the azimuth angular sector is defined as the angular sector in which the light intensity is higher than 50% of the light intensity at the centre of the flat light beam.

According to one embodiment, the size of the elevation angular sector is smaller than 10°, preferably smaller than 3°.

According to one embodiment, the upper reflector and/or the lower reflector have/has a reflective upper surface.

According to one embodiment, the upper reflector has a reflective lower surface and the lower reflector has an absorbent lower surface.

According to one embodiment, the upper reflector and/or the lower reflector have/has at least one metal blade, the metal blade forming the reflective surface. The metal blade is, for example, made of stainless steel.

According to one embodiment, the metal blade has a rough surface state produced by sandblasting or sodablasting. The average depth of the roughness is, for example, greater than 80 μm, preferably greater than 160 μm.

According to one embodiment, each reflector is rectangular in shape and has two longitudinal sides extending parallel to the horizontal generatrix direction and two transverse sides that are oriented at an elevation angle contained within the predefined elevation angular sector of the main flat light beam.

According to one embodiment, each reflector is positioned in a plane parallel to the horizontal plane of symmetry.

According to one embodiment, each reflector is oriented at a non-zero angle with respect to the horizontal plane of symmetry. The angle is, for example, between 0 and 5°.

According to one embodiment, the directrix curve is substantially trapezoidal in shape with a small base, a large base opposite the small base and two sides connecting the small base to the large base, the small base of the trapezium being situated facing the light source.

According to one embodiment, the entry surface of the lens is formed by generating the small base of the directrix curve in the generatrix direction.

According to one embodiment, the exit surface of the lens is formed by generating the large base of the directrix curve in the generatrix direction.

According to one embodiment, the upper surface and the lower surface of the lens are formed by generating the two sides of the trapezoidal shape of the directrix curve in the generatrix direction.

According to one embodiment, the cylindrical lens has a convex interface produced on the large base of the trapezium, the convex interface forming a boss extending in the horizontal generatrix direction and being centred on the horizontal plane of symmetry.

According to one embodiment, the upper reflector is situated above the convex interface and the lower reflector is situated below the convex interface.

According to one embodiment, the upper reflector and the lower reflector are situated at the convex interface.

According to one embodiment, the two sides of the trapezium define two inclined convex external surfaces of the cylindrical lens, the two external surfaces being configured to reflect the light rays so as to bend the light rays into the elevation angular sector of the main flat light beam.

According to one embodiment, the cylindrical lens has a groove extending in the horizontal generatrix direction and formed on the small base of the trapezium, the groove comprising a bottom wall produced in the form of a convex surface.

According to one embodiment, the light source is situated facing the groove in the cylindrical lens.

According to one embodiment, the lower reflector and/or the upper reflector are/is separated from the horizontal plane of symmetry by a distance of less than 25% of the largest vertical dimension of the cylindrical lens.

According to one embodiment, the length of the reflector is substantially equal to the length of the lens. The length is understood to be the largest dimension of the element which corresponds here to the dimension of the elements measured parallel to the horizontal generatrix direction.

According to one embodiment, the ratio of the length of the reflector to the thickness of the reflector is around 100 to 1000. The thickness of the reflector is understood here to be the dimension of the reflector measured in the vertical direction.

By virtue of these features, the overall mechanical bulk of the projector is limited while still allowing stray light rays to be eliminated. In addition, in having a very limited thickness, it is possible to limit the interruption of light rays from the main flat light beam.

According to one embodiment, the invention also provides a light signalling beacon comprising a support and multiple projectors as presented above fixed to the support, the projectors being oriented in distinct directions about a vertical axis such that the azimuth angular sectors of the projectors cover 360° about the vertical axis.

BRIEF DESCRIPTION OF THE FIGURES

The invention will be understood better and further aims, details, features and advantages thereof will become more clearly apparent from the following description of a number of particular embodiments of the invention, which are given solely by way of illustration and without limitation, with reference to the appended drawings.

DESCRIPTION OF THE EMBODIMENTS

Figure 1:
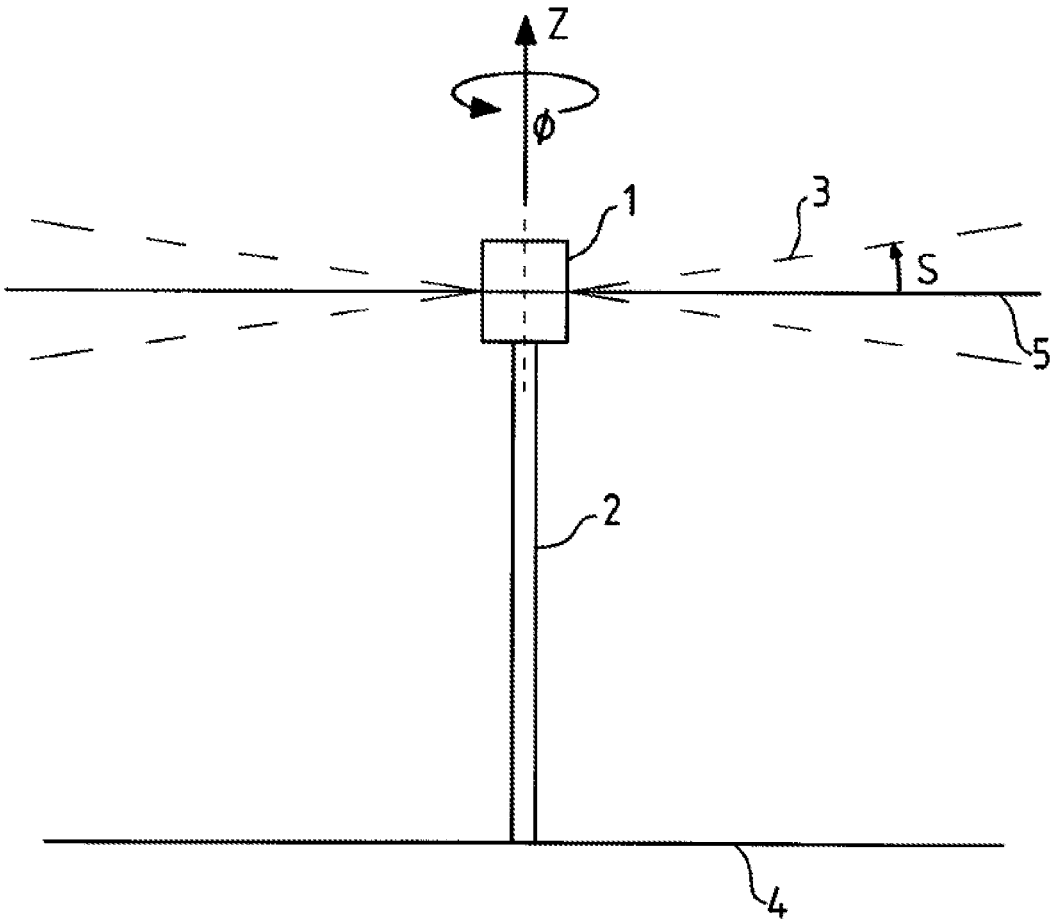
FIG. 1 is a diagram of a light signalling beacon mounted on a post having a vertical axis z.

Referring to FIG. 1, a signalling beacon 1 mounted on a post 2 with a vertical axis z embedded in the ground 4 is shown. The beacon 1 emits a flat light beam 3 all around the vertical axis, which corresponds to an azimuth angular sector Φ of 360°. The flat light beam 3 is represented by dashed lines. The flat light beam 3 is concentrated in an elevation angular sector of elevation angle s centred on a central direction, which is, for example, a plane 5 that is horizontal or slightly inclined relative to the horizontal. The flat light beam 3 has, for example, a luminous intensity of 20 000 cd in the colour white and of 2000 cd in the colour red. The luminous intensity and the colour may be adjusted according to whether it is daytime or night time. This beacon 1 notably makes possible overhead signalling intended for aircraft.

Figure 2:
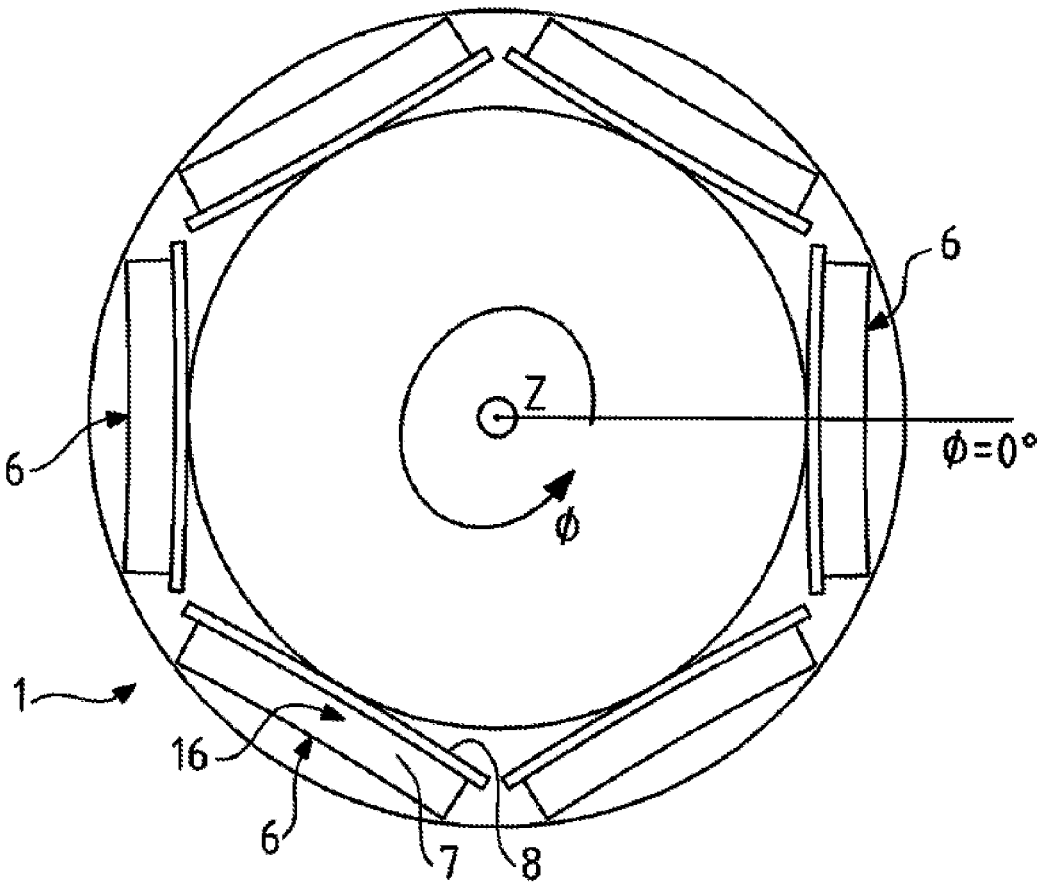
FIG. 2 is a top view of one embodiment of the beacon that comprises 6 projectors.

Referring to FIG. 2, in one illustrative example, the signalling beacon 1 is shown in more detail. Such a beacon has six projectors 6 each having a linear light source and a cylindrical lens 7. In this illustrative example, the linear light source is a strip 16 of light-emitting diodes. The projectors 6 are arranged in a plane perpendicular to the axis z so that the strips 16 of diodes form a regular polygon and emit light towards the outside of the regular polygon. Each projector 6 emits an elementary flat light beam in a defined azimuth angular sector. The beacon emits a 360° directional flat light beam corresponding to the combination of the elementary flat light beams of each projector 6 of the beacon 1. To this end, the minimum azimuth angular sector of each of the six projectors 6 is 360° divided by the number of projectors 6. In this illustrative example, the beacon comprises six projectors 6 and the minimum azimuth angular sector is therefore 60°, i.e. 360°/6. In this illustrative example, the beacon 1 has an overall size of approximately 50 cm. In each projector, the assembly formed by the diode strip 16 and the cylindrical lens 7 may be protected by an opaque metal module 8 open in the direction of emission of the light. The opening of the module may be covered by a glass that does not deflect the light, in order to protect the cylindrical lens from dust.

Figure 3:
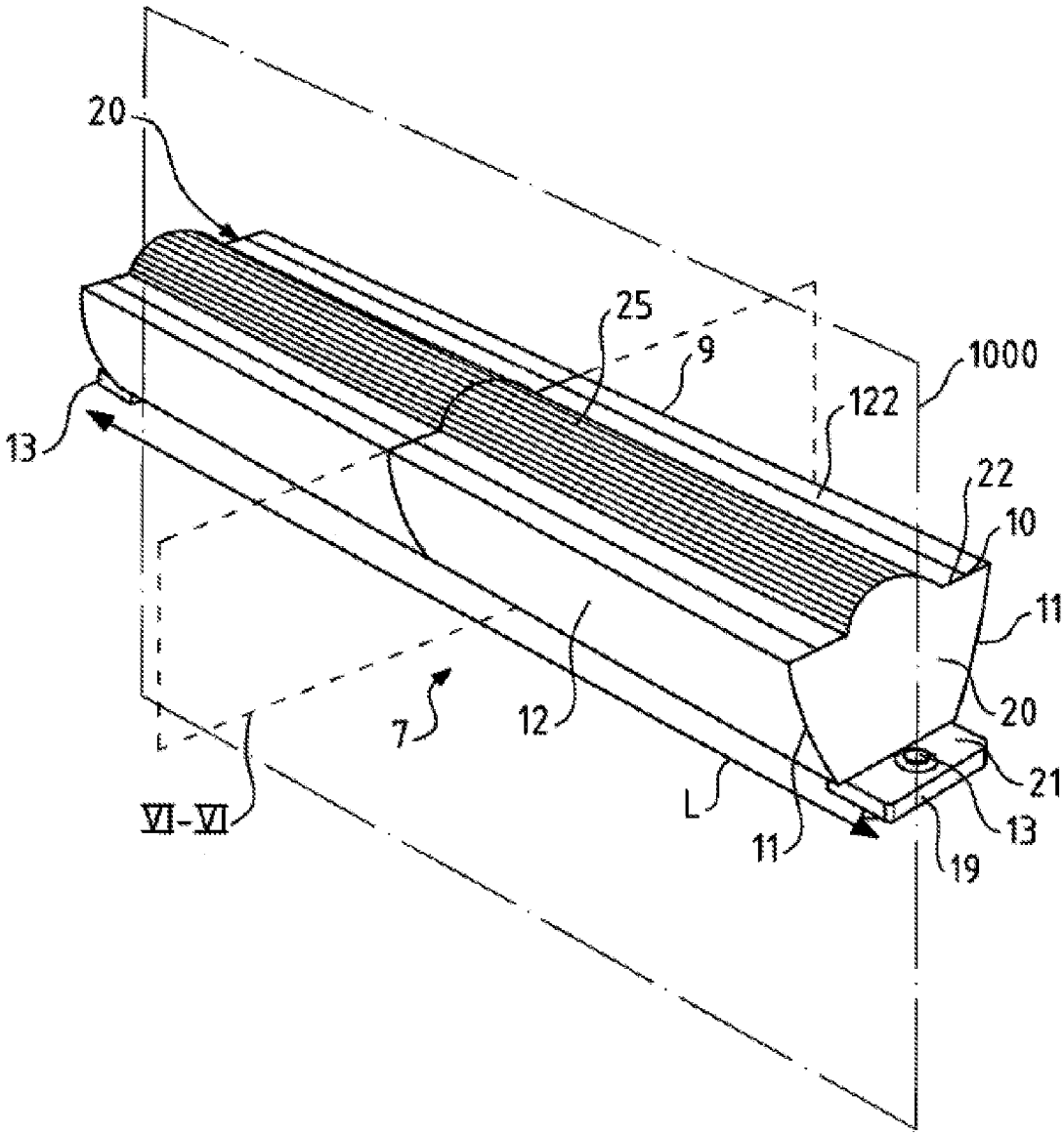
FIG. 3 is a perspective view of a cylindrical lens of a projector of the beacon according to one embodiment.

Referring to FIG. 3, in one illustrative example, a cylindrical lens 7 of a projector 6 is shown. The cylindrical lens 7 has a length L. The cylindrical shape is defined by a horizontal generatrix 9 direction and by a directrix curve 10. The cylindrical lens 7 has two end faces 20 perpendicular to the generatrix 9 direction of the cylinder. The directrix curve 10 has a substantially trapezoidal overall shape with a large base 22 and a small base 21. The sides 11 of the trapezium define two inclined convex external surfaces 12 of the cylindrical lens. The shape of the directrix curve 10 will be explained in greater detail later on with reference to FIG. 6. The cylindrical lens 7 has a support 19 provided with orifices 13. The orifices 13 are intended to accommodate fixing means for fixing the cylindrical lens 7 to a strip 16 of diodes as shown in FIG. 4.

In this illustrative example, the cylindrical lens 7 measures approximately 200 mm and consists mainly of polycarbonate. The large base 22 of the trapezium measures, for example, about 56 mm and the small base 21 of the trapezium measures about 25 mm.

Figure 4:
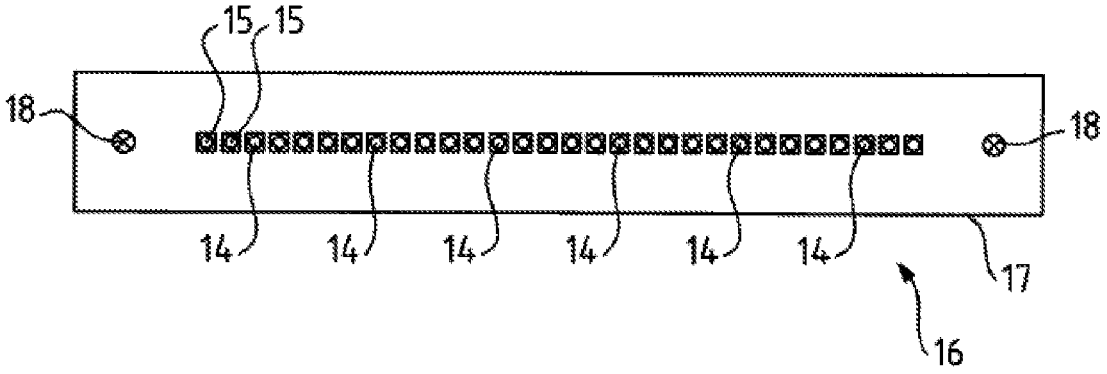
FIG. 4 is a front view of a strip of LEDs that is fixed to the cylindrical lens shown in FIG. 3.

As shown in FIG. 4, the diode strip 16 may have diodes 14, 15 aligned in a linear manner on a plate 17 so as to constitute a linear light source. The diodes of the strip 16 are red diodes 14 successively separated by four respective white diodes 15. The strip 16 also includes orifices 18 so that it can be fixed to the support 19 of the cylindrical lens shown in FIG. 3 in superposition with the orifices 13 present on the support 19.

Figure 5:
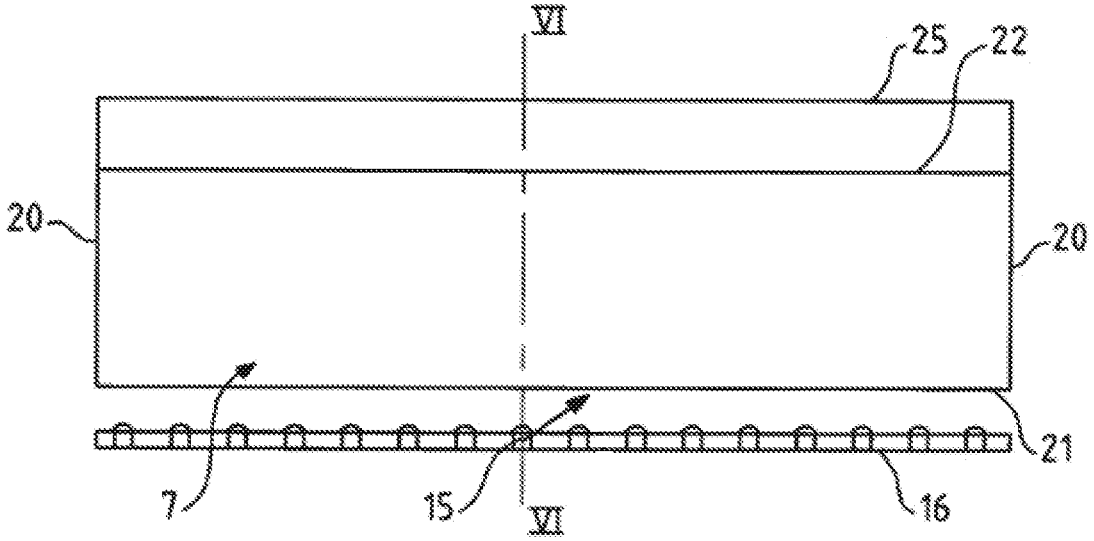
FIG. 5 is a top view of a projector with the strip of LEDs and the cylindrical lens.

FIG. 5 is a diagrammatic representation of the assembly of the cylindrical lens 7 shown in FIG. 3 and the strip 16 of diodes shown in FIG. 4. The strip 16 of diodes is fixed to the cylindrical lens 7 so that the surface of the cylindrical lens 7 defined by the small base 21 of the trapezium faces the face of the strip 16 of diodes that emits light.

Figure 6:
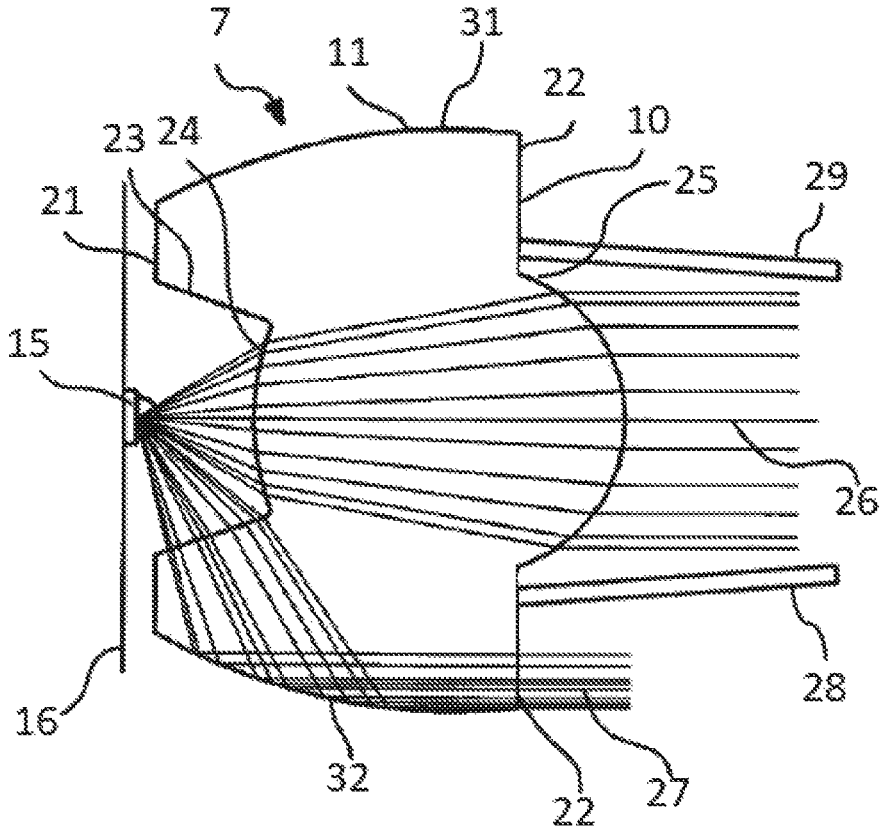
FIG. 6 is a section along the plane VI-VI of the projector shown in FIG. 5, in which are shown the reflectors and the trajectories of the light beams from an LED through the cylindrical lens.
Figure 7:
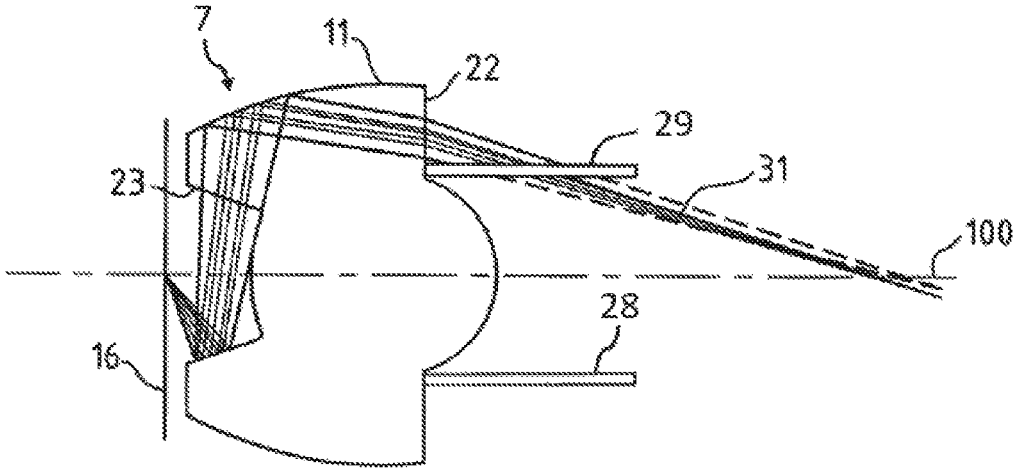
FIG. 7 shows a section along the plane VI-VI of the cylindrical lens showing in projection the light beams from the central LED of the strip of LEDs in the direction of azimuth angle 45° through the lens.

FIGS. 6 and 7 show in more detail the structure of a projector 6 in operation, the projector 6 comprising the cylindrical lens 7 as shown in FIG. 3 and the strip 16 of diodes as shown in FIG. 4.

FIG. 6 is a section along the plane VI-VI of the assembly shown in FIG. 5 showing the trajectories of certain light beams from the diode 15 through the cylindrical lens 7.

The small base 21 of the trapezium is oriented towards the diode 15. The large base 22 of the trapezium is formed opposite the small base 21. The directrix curve 10 has a recess on the small base 21 of the trapezium. This recess defines a groove 23 extending in the generatrix 9 direction on the cylindrical lens 7. The bottom wall of the groove 23 is a convex surface 24 in order to cause convergence of the rays from the strip 16 of diodes in the form of the elementary flat light beam.

The directrix curve has an axis of symmetry 100 perpendicular to the strip 16 such that the cylindrical lens 7 has a first plane of symmetry 1000 created by two generatrices. This amounts to saying that the directrix curve 10 is substantially in the shape of an isosceles trapezium. The cylindrical lens 7 also has a second plane of symmetry, which is the sectional plane IV-IV, intersecting the cylindrical lens at half-length L/2. Specifically, the two end faces 20 are perpendicular to the generatrix 9 direction of the cylinder.

In the sectional plane VI-VI, the rays 26 from the diode 15 in an elevation angular sector approximately centred on the direction perpendicular to the strip 16 pass through the convex surface 24 and are concentrated by a convex interface 25 situated on the large base 22 of the trapezium, after propagating in the cylindrical lens 7 substantially perpendicularly to the generatrix 9. The light rays 26 therefore exit the cylindrical lens 7 in an elevation angular sector approximately centred on the direction perpendicular to the strip 16. The convex interface 25 forms a boss extending in the horizontal generatrix 9 direction and is centred on the horizontal plane of symmetry 5.

The light rays 27 from the diode 15 in the plane VI-VI which are oriented at an angle of 45° to the direction perpendicular to the strip 16 pass through the lateral edges of the groove 23 and are bent towards the sides 11 of the trapezium. The surfaces of the two sides 11 reflect the light rays because of the angle of incidence of the light rays on these surfaces. The reflected rays are therefore bent in the direction approximately perpendicular to the strip 16, such that they emerge from the lens 7 via the large base 22 of the trapezium, passing through a non-convex interface, in an elevation angular sector approximately centred on the direction perpendicular to the strip 16.

Thus, in the sectional plane VI-VI, the light rays 26 and 27 exit the cylindrical lens 7 in a predefined elevation angular sector substantially centred on the direction perpendicular to the strip 16. These rays 26 and 27 define an elementary flat light beam. In other words, the cylindrical lens 7 has a collimator function.

As shown in FIGS. 6 and 7, the projector also has a lower reflector 28 and an upper reflector 29 which are positioned on the surface 30 defined by the large base 22 of the trapezium. Each reflector 28, 29 has a thickness that is small relative to the dimensions of the lens 7 so that the wanted light rays are not interrupted, for example 0.5 mm thick, a length substantially equal to that of the cylindrical lens, for example 200 mm, and a width of the order of 20 mm. The longitudinal sides 39 of each reflector 28, 29 are parallel to the generatrix 9 direction. The transverse sides 38 of each reflector 28, 29 are oriented in the direction of transmission of the light rays 26 exiting the cylindrical lens 7. In the embodiment of FIG. 7, each reflector 28, 29 is situated in a plane parallel to the horizontal plane of symmetry 1000, and therefore to the main direction of the elementary flat light beam from the projector 6. In the embodiment of FIG. 6, each reflector 28, 29 is inclined with respect to the horizontal plane of symmetry 1000 by a non-zero angle, for example of the order of 3 to 5° and so as to be inclined towards the plane of symmetry 1000.

The upper reflector 29 is positioned above the plane of symmetry 1000 of the cylindrical lens 7 and below an upper surface 31 of the cylindrical lens 7. The lower reflector 28 is positioned below the horizontal plane of symmetry 1000 of the cylindrical lens 7 and above a lower surface 32 of the cylindrical lens 7 so as to interrupt, i.e. reflect or absorb, light rays from the light source which are oriented outside the elevation angular sector of the main flat light beam. The upper surface 31 is formed by the convex outer surface 12 of the lens 7 situated above the strip 16 while the lower surface 32 is formed by the convex outer surface 12 of the lens 7 situated below the strip 16.

As shown in FIG. 6 in particular, the upper reflector 29 and the lower reflector 28 are arranged symmetrically with respect to the horizontal plane of symmetry 1000. In addition, the upper reflector 29 and the lower reflector 28 are each arranged in a plane intersecting the small base 21 so as not to interrupt the light rays 27 which are deflected by the convex outer surfaces 12 and which would form part of the main flat beam 3.

According to one preferred embodiment, the lower reflector 28 has a reflective metal blade, i.e. it is reflective for radiation in the visible range, formed on an upper surface of the lower reflector 28 in order to reflect stray light rays 33 upwards. The advantage of a reflective surface that reflects stray light rays 33 is that it limits absorption of the light energy from the stray rays, and therefore heating of the reflector 28 and of the light projector in general. The lower surface of the lower reflector 28 may be formed by a surface that is opaque to radiation in the visible range, i.e. an absorbent surface. The lower and upper surfaces of the reflectors 28, 29 may also be rough, for example produced by sandblasting or sodablasting.

According to one preferred embodiment, the upper reflector 29 has a reflective metal blade formed on an upper surface of the upper reflector 29 in order to reflect stray light rays 33 upwards and downwards. According to another embodiment, the upper reflector 29 consists of a reflective metal blade.

FIG. 7 shows a section similar to FIG. 6 for which other light rays are shown. In this FIG. 7, there are shown projected onto the section VI-VI the light rays 31 from the centre diode 15 of the strip 16 of diodes in the direction with the azimuth angle of 45° through the lens. In the absence of a reflector, the light rays 31 produce stray luminous intensity at the elevation angle s=−10° greater than 3% of the luminous intensity at the location of the maximum intensity of the elementary flat light beam, i.e. at the elevation angle s=0°. The elevation angle s is defined relative to the horizontal 5 corresponding to the elevation angle s=0°. Stray light is defined as light outside the predefined elevation angular sector of the elementary flat light beam whose luminous intensity is greater than 3% of the maximum luminous intensity in the predefined elevation angular sector.

In FIG. 7, the stray light rays 31 that encounter the upper reflector 29 do not pass through it. They are shown artificially in FIG. 7 to explain the origin of the stray light intensity that is eliminated in particular by placing the upper reflector 29 on the cylindrical lens 7, and similarly for other stray rays 31 for the lower reflector 28.

Figure 8:
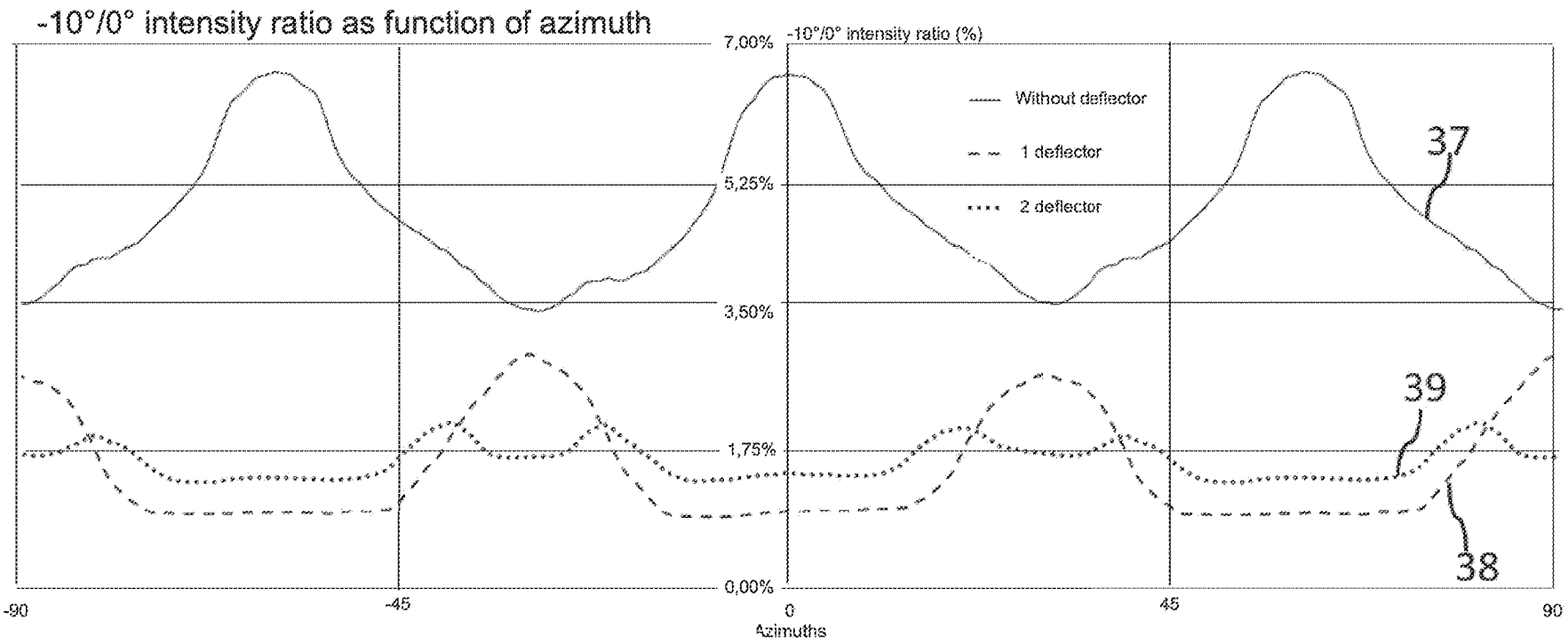
FIG. 8 is a graph showing the ratio of the luminous intensity from a projector at the elevation angle −10° to the luminous intensity from a projector at the elevation angle 0° as a function of the azimuth angle for a first projector provided with two reflectors according to the invention, for a second projector identical to the first but provided with a single reflector, and for a third projector identical to the first but not provided with a reflector.

FIG. 8 allows the effects of the two reflectors 28, 29 on a projector 6 to be illustrated by comparing such a projector 6 with projectors of the prior art provided with just one reflector or without a reflector.

FIG. 8 shows a graph showing the ratio in terms of % of the light intensity I at the elevation angle s=−10° to the light intensity I at the elevation angle s=0° as a function of the azimuth angle Φ. The −10°/0° intensity ratio makes it possible to quantify the intensity of the stray radiation with respect to the radiation of the main flat beam 3. On this graph, it is possible to see a first curve 37 representing a projector 6 without a reflector, a second curve 38 representing a projector 6 provided with a single reflector, and a third curve 39 representing a projector 6 from one embodiment provided with an upper reflector 29 and a lower reflector 28. For these curves to be comparable, the measurements were carried out on projectors 6 that differ only in the number of reflectors.

Thus, it is observed with the first curve 37 that the stray radiation for a projector without a reflector is between about 3.5% and 6.8% of the radiation of the main flat beam 3 at the elevation angle s=0°. It is observed with the second curve 38 that the stray radiation for a projector provided with a single reflector is between 0.9% and 3%. Finally, it is also observed with the third curve 39 that the stray radiation for a projector with the upper reflector and the lower reflector is between about 1.3% and 2%.

While the addition of a single reflector already allows the stray radiation at the elevation angle s=−10° to be brought below 3%, the arrangement of a second reflector allows the maximum amount of this stray radiation to be decreased to a light intensity of less than 2% of the intensity of the main flat beam at the elevation angle s=0°.

In conclusion, the presence of a lower reflector 28 and of an upper reflector 29 makes it possible to decrease the radiation at the elevation angle s=−10° to values of less than 2% of the light intensity of the main flat beam at the elevation angle s=0°.

The beacons described above can be produced with numerous types of light sources, notably LEDs, fluorescent tubes, discharge lamps, etc. The light may be of different colours, and might or might not blink, depending on the desired lighting characteristics.

The cylindrical lens may be manufactured in numerous materials, for example glass, polycarbonate, transparent flexible resin, for example flexible resin including polyurethane compounds, for example a VT3402 series resin.

Although the invention has been described in connection with a number of particular embodiments, it is obvious that it is in no way limited thereby and that it comprises all the technical equivalents of the means described and the combinations thereof where these fall within the scope of the invention.

The use of the verb "have", "comprise" or "include" and of the conjugated forms thereof does not exclude the presence of elements or steps other than those set out in a claim.

In the claims, any reference sign between parentheses should not be interpreted as limiting the claim.

The invention claimed is:

1. Light projector (6) intended to produce a directional flat light beam (3) for signalling high obstacles, the projector comprising:

an elongate cylindrical lens (7) the cylindrical shape of which is defined by a horizontal generatrix direction (9) and by a directrix curve, the cylindrical lens (7) having a length along the horizontal generatrix direction (9), the cylindrical lens (7) having a horizontal plane of symmetry, in which the directrix curve is substantially trapezoidal in shape with a small base (21), a large base (22) opposite the small base (21) and two sides (11) connecting the small base (21) to the large base (22), the small base (21) of the trapezium being situated facing the light source (16), and in which the cylindrical lens (7) has a convex interface (25) produced on the large base (22) of the trapezium, the convex interface (25) forming a boss extending in the horizontal generatrix direction (9) and being centered on the horizontal plane of symmetry (1000);

a linear light source (16) parallel to the generatrix direction (9), extending over all or part of the length of the cylindrical lens (7) and arranged to emit a flux of light in the direction of the cylindrical lens (7), the cylindrical lens (7) being configured to generate a main flat light beam (3) by concentrating the flux of light in an predefined elevation angular sector around the horizontal generatrix direction (9) in the direction of the space situated on the side opposite the cylindrical lens (7) with respect to the light source (16), and being configured to project the flux of light in a predefined azimuth angular sector around the vertical direction; and at least two reflectors positioned in the space situated on the side opposite the light source (16) with respect to the cylindrical lens (7), and in which at least one of the reflectors is an upper reflector (29) positioned above the horizontal plane of symmetry (1000) of the cylindrical lens (7) and below an upper surface (31) of the cylindrical lens (7), and at least one of the reflectors is a lower reflector (28) positioned below the horizontal plane of symmetry (1000) of the cylindrical lens (7) and above a lower surface (32) of the cylindrical lens (7), the reflectors being configured to interrupt light rays from the light source (16) which are oriented outside the elevation angular sector of the main flat light beam (3), and wherein the upper reflector (29) is situated above the convex interface (25) and the lower reflector (28) is situated below the convex interface (25).

2. Light projector (6) according to claim 1, in which the upper reflector (29) and/or the lower reflector (28) have/has a reflective upper surface.

3. Light projector (6) according to claim 2, in which the upper reflector (29) and/or the lower reflector (28) have/has at least one metal blade, the metal blade forming the reflective surface.

4. Light projector (6) according to claim 1, in which the upper reflector (29) has a reflective lower surface and the lower reflector (28) has an absorbent lower surface.

5. Light projector (6) according to claim 1, in which each reflector (28, 29) is rectangular in shape and has two longitudinal sides parallel to the horizontal generatrix direction (9) and two transverse sides that are oriented at an elevation angle (s) contained within the predefined elevation angular sector of the main flat light beam (3).

6. Light projector (6) according to claim 1, in which the two sides (11) of the trapezium define two inclined convex external surfaces of the cylindrical lens (7), the two external surfaces being configured to reflect the light rays so as to bend the light rays into the elevation angular sector of the main flat light beam (3).

7. Light projector (6) according to claim 1, in which the cylindrical lens (7) has a groove (23) extending in the horizontal generatrix direction (9) and formed on the small base (21) of the trapezium, the groove (23) comprising a bottom wall (24) produced in the form of a convex surface.

8. Light projector (6) according to claim 1, in which the lower reflector (28) and/or the upper reflector (29) are/is separated from the horizontal plane of symmetry by a distance of less than 25% of the largest vertical dimension of the cylindrical lens (7).

9. Light signalling beacon (1) comprising a support (19) and multiple projectors (6) according to claim 1 fixed to the support, the projectors (6) being oriented in distinct directions about a vertical axis such that the azimuth angular sectors of the projectors cover 360° about the vertical axis.

* * * * *